United States Patent [19]

Wunner

[11] 4,369,639

[45] Jan. 25, 1983

[54] WARP KNITTING MACHINE APPARATUS

[75] Inventor: Roland Wunner, Bernstein, Fed. Rep. of Germany

[73] Assignee: LIBA Maschinenfabrik GmbH, Naila, Fed. Rep. of Germany

[21] Appl. No.: 240,231

[22] Filed: Mar. 3, 1981

[30] Foreign Application Priority Data

Mar. 4, 1980 [DE] Fed. Rep. of Germany ..... 3008277

[51] Int. Cl.[3] ..... D04B 23/00

[52] U.S. Cl. ..... 66/203; 66/109

[58] Field of Search ..... 66/203, 208, 104, 109

[56] References Cited

U.S. PATENT DOCUMENTS 4,202,185 5/1980 Lesley ..... 66/203

*Primary Examiner*—Ronald Feldbaum

*Attorney, Agent, or Firm*—Anthony A. O'Brien

[57] ABSTRACT

An apparatus for a warp knitting machine is disclosed as including individual sinkers movable between needles that hold a fabric, two right-angles sides of each sinker are disposed so that each knitted stitch row may be held away from the back of the needle.

2 Claims, 1 Drawing Figure

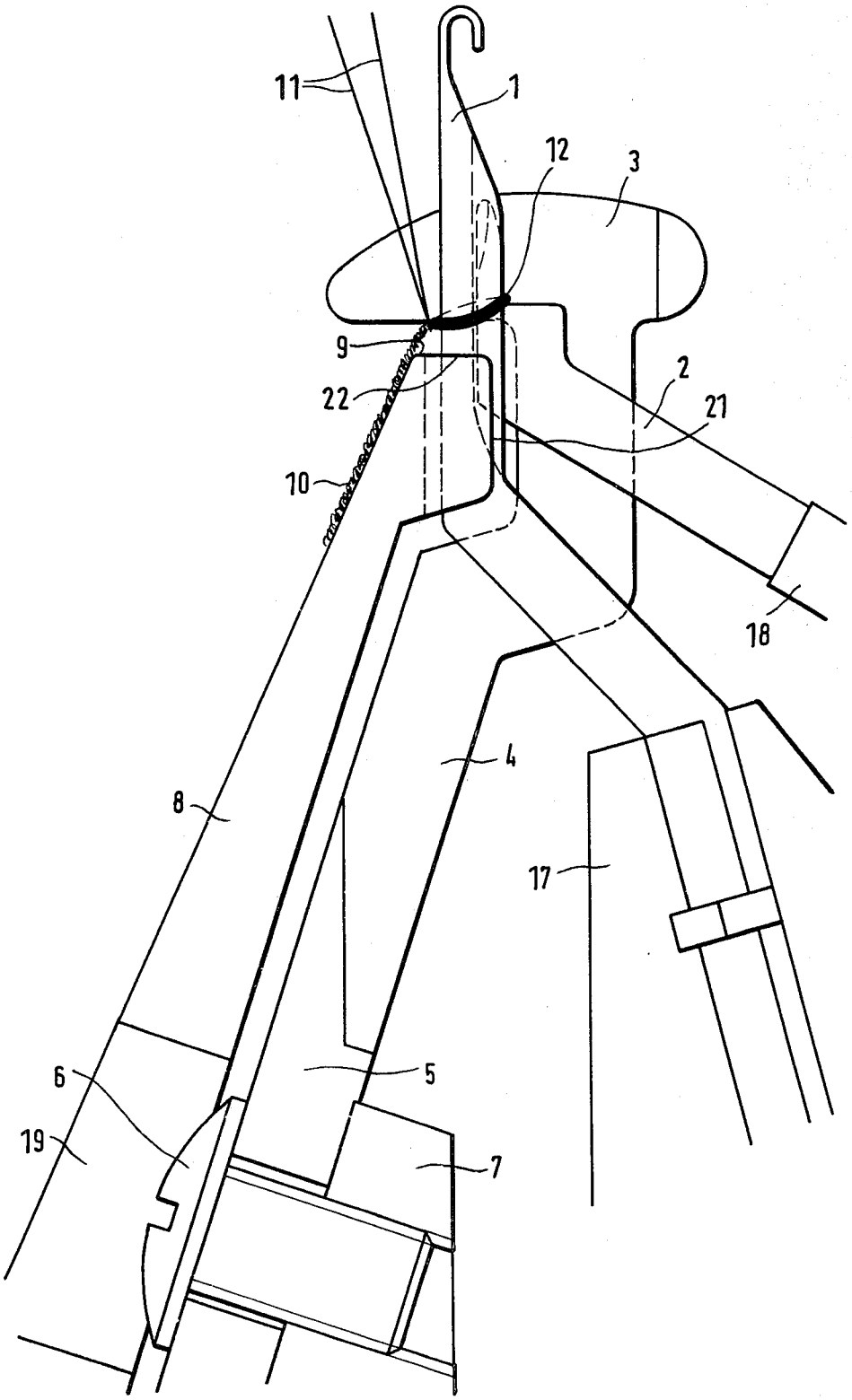
11
1
12
3
9
22
2
21
10
18
4
8
17
6
5
19
7

WARP KNITTING MACHINE APPARATUS

BACKGROUND OF THE INVENTION

1. Field of the Invention

This invention relates to a warp knitting machine apparatus and, more particularly to such a machine which withdraws the fabric over an edge of the machine's knock-over bar.

2. Description of the Prior Art

The prior art is aware of a warp knitting machine with withdrawal of the fabric over a fixed knock-over edge of a knock-over bar and having a piercing comb consisting of single sinkers and movable to and fro between the needles which holds the fabric, with its lower edge extending approximately at right angles to the needles, in a specific position in relation to the knock-over edges. Such a machine is shown in German Pub. Spec. No. 2,127,970 which is incorporated herein by reference.

Ordinarily in such a machine the drive of the piercing comb is effected by means of a mechanism which grasps over the needle bar and the slider bar in the case where slider needles are used, so that this mechanism covers over the securing points for the needles and the sliders on their bars. In order to replace needles or sliders for example in the case of a fault, it is then necessary to hinge this mechanism away.

SUMMARY OF THE INVENTION

The present invention is summarized in a warp knitting machine apparatus which withdraws a fabric over a fixed knock-over edge of a knock-over bar, has a piercing comb including single sinkers movable to and fro between needles that hold the fabric, a needle slider for moving each needle, the sinker having a lower edge extending approximately at right angles to the needles in a specific position in relation to the knock-over edge, characterized in that a sinker bar for a sinker mounting is disposed between the knock-over bar and a needle bar for the needle.

OBJECTS OF THE INVENTION

An object of the present invention is to eliminate the disadvantage of a mechanism covering the securing points for needles and/or needle sliders in a warp knitting machine.

The present invention has another object in that a warp knitting machine apparatus provides accessibility to the machine's needles and/or needle sliders.

A further object of this invention is to construct a warp knitting machine apparatus in a simple and efficient manner.

Other objects and advantages of the present invention will become apparent from the following description taken in conjunction with the accompanying drawing.

BRIEF DESCRIPTION OF THE DRAWING

The single FIGURE of the drawing is a schematic diagram illustrating the sinker bar location of a warp knitting machine embodying the present invention.

DESCRIPTION OF THE PREFERRED EMBODIMENT

The invention is based upon the problem of eliminating this disadvantage and improving the accessibility of the securing points for the needles and the sliders. In accordance with the invention this occurs in that the bar for the piercing comb is arranged between the knock-over bar and the bar for the needles.

By reason of this construction the individual sinkers of the piercing comb extend through the needles so that the bars for the needles and the sliders are not covered, from the slider side, by the bar for the piercing comb.

The arrangement of the bar for the piercing comb between the knock-over bar and the bar for the needles furthermore makes available the possibility of bringing the relatively heavy bar for the piercing comb close to the pivot spindle for the reciprocating movement of the piercing comb. On the other hand in known machines the bar for the piercing comb is reached from the axis of oscillation by way of a relatively long lever arm. In the latter case thus a centre of gravity results lying relatively far away from the axis of oscillation, in contrast to a centre of gravity lying relatively close to the axis of oscillation in the case of the machine according to the invention, which accordingly permits a higher working frequency.

So that the possibility remains of replacing the piercing comb or parts thereof, piercings are provided in the knock-over bar in front of securing elements for the piercing comb. By reason of these piercings, securing elements, for example screws on the bar for the piercing comb, remain freely accessible.

An example of embodiment of the invention is represented in the FIGURE. The slider needle 1 with its slider 2 is shown. These two components are actuated in known manner. Moreover one sinker 3 of the piercing comb is illustrated. Each sinker 3 is seated on the sinker shank 4 which merges together with the sinker shanks of adjacent sinkers, into the sinker mounting 5. The individual sinker mountings 5 are then secured by means of the screw 6 to the sinker bar 7.

The sinker 3 carries out a reciprocating movement transversely of the longitudinal direction of the needle 1, which movement is imparted to it through the sinker bar 7 in known manner, similarly to the case of the needle 1 and the slider 2.

The knock-over bar 8 with its knock-over edge 9, over which the completed knitted fabric 10 is withdrawn, is fitted laterally beside the sinker shank 4. The fabric is knitted from the warp threads 11 which are illustrated drawn together in the stitch loop 12 in the FIGURE. The stitch loop 12 is illustrated laid around the shank of the needle 1.

The sinker shank 4 is conducted laterally past the needle 1 and the slider 2, thus it extends through between these components. This is attributable to the fact that the bar 7 for the piercing comb with the sinkers 3 is arranged between the knock-over bar 8 and the bar 17 for the needles 1. Thus the object is achieved that the space before the slider mountings 18, which merge into the slider bar (not shown), remains free so that with the arrangement as illustrated it is also possible easily to replace needle 1 or slider 2. Moreover this arrangement results in better accessibility and clarity of lay-out of the working station, so that in the case of a thread breakage it is easier to thread in a new thread.

So that now even in the case of replacement of a sinker (together with the sinker mounting 5) the relevant securing screw 6 remains easily accessible, a piercing or opening 19 is provided in the knock-over bar 8 before each screw 6. A screw driver for example can readily be guided through the piercing or opening 19 in order to release the screw 6.

The protuberence 21 extends out of the knock-over bar 8 laterally beside the knock-over edge 9, and in the arrangement as a whole several such protuberances 21 are situated side by side. Thus a comb-like arrangement of protuberances 21 extending into the interspaces between the needles 1 results. This arrangement known per se ensures that in the extraction of the needle 1 from the stitch 12 the latter, if in is then also drawn downwards, can travel only a short way, namely as far as the edge 22 of the stop 21. Consequently it is not possible for a stitch 12 to be drawn far downwards to behind the knock-over edge 9.

Inasmuch as the present invention is subject to many modifications, alterations and changes in details, it is intended that all matter contained in the foregoing description or shown on the accompanying drawings shall be interpreted as illustrative and not in a limiting sense.

What is claimed is:

1. A warp knitting machine apparatus which withdraws a fabric (10) over a fixed knock-over edge (9) of a knock-over bar (8), has a piercing comb including single sinkers (3) moveble to and fro between needles (1) that hold the fabric, a needle slider (2) for moving each needle, said sinker (3) having a lower edge extending approximately at right angles to the needles (1) in a specific position in relation to the knock-over edge (9) characterized in that a sinker bar (7) for a sinker mounting (5) is disposed between the knock-over bar (8) and a needle bar (17) for the needle (1).

2. A warp knitting machine according to claim 1, characterized in that openings (19) are provided in the knock-over bar (8) in front of securing elements (6) for the piercing comb.

* * * * *